US006905446B2

(12) United States Patent
Greenland

(10) Patent No.: US 6,905,446 B2
(45) Date of Patent: Jun. 14, 2005

(54) EXERCISE DEVICE

(76) Inventor: Darrell Greenland, 934 - 4th St., #21, Santa Monica, CA (US) 90403

( * ) Notice: Subject to any disclaimer, the term of this patent is extended or adjusted under 35 U.S.C. 154(b) by 367 days.

(21) Appl. No.: 10/053,325

(22) Filed: Jan. 17, 2002

(65) Prior Publication Data

US 2003/0134723 A1 Jul. 17, 2003

(51) Int. Cl.[7] ..... A63B 21/062; A63B 21/00

(52) U.S. Cl. ..... 482/100; 482/98; 482/104; 482/137

(58) Field of Search ..... 482/135, 101, 482/100, 104, 106, 108, 137, 98–99

(56) References Cited

U.S. PATENT DOCUMENTS

| | | | | | |
|---|---|---|---|---|---|
| 4,973,050 | A | | 11/1990 | Santoro et al. | 272/117 |
| 4,998,723 | A | | 3/1991 | Santoro | 272/117 |
| 5,044,632 | A | * | 9/1991 | Jones | 482/138 |
| 5,050,868 | A | | 9/1991 | Pearson | 272/117 |
| 5,098,361 | A | | 3/1992 | Danylieko | 482/97 |
| 5,116,297 | A | | 5/1992 | Stonecipher | 482/97 |
| 5,215,510 | A | | 6/1993 | Baran | 482/104 |
| 5,407,403 | A | | 4/1995 | Coleman | 482/6 |
| 5,569,133 | A | | 10/1996 | Vittone | 482/98 |
| 5,653,666 | A | | 8/1997 | Pantoleon | 482/112 |
| 5,669,859 | A | | 9/1997 | Liggett et al. | 482/94 |
| 5,688,216 | A | | 11/1997 | Mauriello | 482/135 |
| 5,716,306 | A | | 2/1998 | Gallay | 482/104 |
| 5,788,614 | A | * | 8/1998 | Simonson | 482/97 |
| 5,788,616 | A | | 8/1998 | Polidi | 482/104 |
| 5,810,701 | A | * | 9/1998 | Ellis et al. | 482/136 |
| 5,813,951 | A | | 9/1998 | Einsig | 482/97 |
| 5,971,897 | A | | 10/1999 | Olson et al. | 482/101 |
| 5,971,898 | A | | 10/1999 | Schoolfield | 482/104 |
| 6,056,678 | A | | 5/2000 | Giannelli et al. | 482/137 |
| 6,254,516 | B1 | * | 7/2001 | Giannelli et al. | 482/100 |
| 6,379,287 | B1 | * | 4/2002 | Slawinski et al. | 482/104 |

OTHER PUBLICATIONS

LATimes Advertisement Oct. 4, 2001—EXERCERA 160# chrome Weight Set.

* cited by examiner

*Primary Examiner*—Justine R. Yu
*Assistant Examiner*—Fenn C. Mathew
(74) *Attorney, Agent, or Firm*—Cislo & Thomas LLP

(57) ABSTRACT

A self-spotting free weight device wherein the free weights are retained by arms which are pivotal in the horizontal plane of the arm and wherein the supporting arms are also pivotally supported from a support structure such that they move in a plane perpendicular to the plane in which the free weights may be moved.

11 Claims, 10 Drawing Sheets

EXERCISE DEVICE

BACKGROUND OF THE INVENTION

1. Field of the Invention

This invention relates to weight lifting machines and devices, more particularly to a self-spotting weight lifting machine where the weightlifter can lift weights until weary and be able to release the weights without dropping them.

2. Description of the Related Art

Weightlifting is well known in the art, and is a recognized Olympic sport. Additionally, weightlifting provides muscular development especially for the upper body and long muscles of the legs. Weightlifting gyms have become very popular places for activity and socializing as physical exercise generally forms a portion of most persons' days.

When lifting weights, much of the muscle development occurs once the muscles have been warmed up, and become weary from the weightlifting activity. This is particularly true for bodybuilders who lift small weights a great number of times in order to achieve better definition of particular muscle groups. Power lifters generally focus upon the amount of weight that they can lift, and also engage in "repetitions" where a weight of a certain amount is lifted a number of times repeatedly.

In most of these activities, barbells or dumbbells are used. Because the weightlifting activity generally brings the weightlifter to the limit of his or her endurance, it is common to have a second person, called a "spotter," to help the person at the end of the repeated lifting cycle where the weightlifter's endurance begins to fail. The spotter is there to help the weightlifter lift the weight back onto a weight stand (that holds the weight) should the weightlifter be unable to return the weight to the stand. This is an important safety function, as the weight could either drop to the floor or the weightlifter, possibly injuring the weightlifter. The possibility of the latter case can arise when the weightlifter is reclined on a bench and lifting a barbell upwardly in a manner that, due to the weightlifter's reclining position, is directly over the weightlifter. When the weightlifter cannot return the weight to the stand, the barbell then descends by gravity onto the weightlifter. This can be particularly difficult if the barbell should engage the weightlifter's throat or windpipe. Generally, the weightlifter in distress would then turn the barbell to allow it to drop to the floor. However, this is a situation to be avoided, as it shows a lack of control and may injure the equipment as well as third persons.

Consequently, it is a shortcoming present in the art as there are a few, if any, exercise machines or exercise devices that allow the weightlifter to operate on his or her own without demanding the attention and time of a spotter.

There have been previous attempts made in the art with respect to self-spotting weightlifting devices.

U.S. Pat. No. 4,973,050 issued to Santoro on Nov. 27, 1990 for a Pulleyless Weightlifting Apparatus is directed to an apparatus for facilitating free weight exercises so as to prevent injury using barbells or dumbbells. The exercise apparatus 10 has a pair of bases 60, 62 supporting posts 34, 37 containing counterweights 72, 75 that are connected to cables 44, 47 that have connectors at the opposite end for connecting a barbell or dumbbells. The posts have a plurality of apertures for receiving stop pins 8 to limit the travel of the counterweights and also receive hooks 5 for supporting the barbell at a selected location. The weight lifting apparatus allows unrestricted movement of the weight bar or dumbbells, but provides safety to the user, but in a manner differing structurally from the present invention.

U.S. Pat. No. 5,407,403 issued to Coleman on Apr. 18, 1995 for a Forcer Repetition Assist Device is directed to a mechanical weight lifting partner that can be proprogrammed for operational parameters to allow predetermined weight lifting performance with the training partner being transparent to the user unless parameters are exceeded and assistance is necessary. The apparatus 1 has a vertical unit 92 that contains a control unit 58 containing a microprocessor-based control unit 58 that controls a motor controller that is coupled to a system containing a motor 56, clutch 52, encoder 35, as well as a roller chain drive with sprockets and a cable system. The apparatus is programmed through a keypad 72 so that with a barbell 2 or dumbbells 6, 12 connected to cable 22, exercises can be performed without the apparatus being involved unless the encoder determines that rates are being exceeded, then clutch is engaged and assistance is provided to the weight lifter.

U.S. Pat. No. 5,788,616 issued to Polidi on Aug. 4, 1998 for a Mechanical Weightlifting Machine is directed to a mechanical weight lifting machine that serves as a human spotter. The mechanical spotter 10 has a support frame 18 with a vertical support structure 25. An articulating mechanism 32 is provided that can selectively be used with dumbbells or a barbell. The articulating unit has a counterweight 44 that can be adjusted to balance out the weight of the machine so no resistance is felt by the user in raising or lowering free weights, if desired. Drive motor 60 and a foot control 58 are provided for weight adjustment. Rods 40 are suspended from the articulating unit with lower ends 42 that can be connected to a dumbbell or barbell. The downward swing of the weights are limited by stops 72 and the support frame includes a pair of weight rests 74. The disclosed structure does not allow for pivotal displacement in the horizontal plane.

U.S. Pat. No. 5,971,897 issued to Olson et al. on Oct. 26, 1999 for a Multi-Purpose, Natural-Motion Exercise Machine is directed to a multipurpose natural motion exercise machine permitting safe free-ranging motion. The machine has handlebars 26 that are supported on a bearing sleeve 20 that rides on horizontal shaft 16. Shaft 16 is coupled to main bearing sleeve 14 that rides on main shaft 12. Vertical bearing sleeve 14 has a weight bar 30 upon which a desired amount of weights are placed. A safety catch 38 is placed on the vertical shaft to limit the downward motion of the handles and a safety catch 36 is installed on the horizontal shaft 16. The user can provide repetitions of weight lifting using natural elliptical motions provided by bearing slides.

U.S. Pat. No. 4,998,723 issued to Santoro on Mar. 12, 1991 for a Cable Suspended Dumbell [sic] and Barbell Weightlifting Apparatus is directed to a cable suspended dumbbell and barbell weightlifting apparatus that provides safety to the user. The exercise apparatus 10 can support dumbbells 54 or a barbell 80 on the end of the two cables 58 that can be adjusted to a pre-selected height by positioning slider assemblies 44, 46 on guide track support members 40 and inserting key stops 32 through holes 60 in the guide track.

It can be seen that the art would be advanced by a self-spotting exercise device that would allow weightlifters to lift weights without risking injury or dropping the weights, as well as requiring the services of a spotter. This would further allow individuals to exercise with weights independently of others, as well as providing a safe means by which to do so.

SUMMARY OF THE INVENTION

The present invention uses a horizontal supporting member upon which free weight connecting members rest when not in use. Free weights, such as dumbbells or barbells, can be attached to the free weight connecting members which are then supported by the horizontal supporting member. In so doing, the present invention generally provides a support structure for free weights that includes a pair of omnidirectional arms adapted to support or mount weights thereon. Consequently, while the present invention provides support and self-spotting for free weights, minimal restriction is placed upon the range of motion of such free weights.

To provide retrofittable attachment to current exercise devices or the like, a vertical attachment member generally provides support for both the horizontal supporting member as well as horizontally and vertically extending members that serve to space the free weight connecting members apart.

The horizontal extending members extend horizontally rearwardly from the vertical attachment member at an angle. The vertical coupling members are then attached to the horizontally extending member in a pivotable fashion. The free weight connecting members are then pivotably attached to the vertical coupling members. Forward motion of the free weight connecting members is inhibited by a stop that prevents the pivoting motion of the vertical coupling members. Without such stops, the vertical coupling members could allow the free weight connecting member to pivot downwardly, dropping the weight toward the floor.

The vertical attachment member can then be attached to an existing exercise machine, may be used separately with a vertical support of one kind or another, or may be retrofitted to weight stands or the like. In an alternative embodiment, the horizontal supporting member may have vertical posts that substitute for the vertical attachment members attachment to a vertical support. The vertical support is then delivered by the vertical posts attached to the horizontal supporting member with operation much the same as with the other embodiments.

Additionally, a barbell or other weight clamp is disclosed that allows secure engagement of a barbell for use in the present invention or otherwise.

OBJECTS OF THE INVENTION

It is an object of the present invention to provide an exercise device that allows weights to be supported when not subject to a weightlifter's activities.

It is another object of the present invention to provide a self-spotting exercise device that allows a weightlifter to support weights after a cycle of weightlifting activity.

It is another object of the present invention to provide a self-spotting exercise device that enables free weights to have unrestricted movement while attached to arms.

It is yet another object of the present invention to provide a self-spotting weightlifting device that allows a weightlifter to engage or disengage weights in a safe and controlled manner without the use of a human spotter.

It is yet another object of the present invention to provide an exercise device that is retrofittable to currently-existing exercise devices.

It is yet another object of the present invention to provide a self-spotting exercise weightlifting exercise machine that is easily used and manufactured.

It is yet another object of the present invention to provide a weightlifting system for a weightlifter that replicates free-range or unrestricted movement and a natural range of motion including a generally omni-directional manner in a self-spotting weightlifting system.

These and other objects and advantages of the present invention will be apparent from a review of the following specification and accompanying drawings.

DESCRIPTION OF THE PREFERRED EMBODIMENT(S)

Figure 1A:
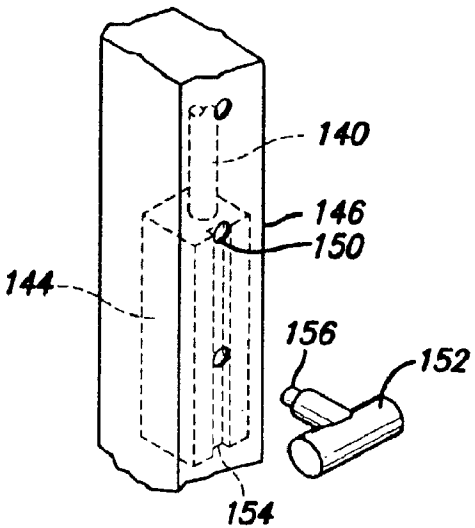
FIG. 1A is an enlarged partially phantom and exploded view of the pin-based attachment system used in the present invention as shown in circle 1A of FIG. 1.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The exercise device 100, or self-spotting exercise attachment 100, enables the weightlifter W to lift weights safely and controllably without the use of a human spotter. To do so, a horizontal supporting member 102 which may have upstanding flanges or retainers 104 is connected to a vertical attachment member 106. The attachment between the horizontal supporting member 102 and the vertical attachment member 106 may be as by welding, precast molding, or the like. Extending rearwardly on either side of the vertical attachment member 106 are horizontal extending members 108 which extend rearwardly and away from the weightlifter W at an angle from the vertical attachment member 106. The angle and length of the horizontal extending member 108 is discussed in more detail below with respect to the proper support of the weights.

Pivotably attached to the horizontal extending member 108 is a vertical coupling member 110. The vertical coupling member 110 is coupled in a pivotable fashion to the horizontal extending member 108. In one embodiment, the vertical coupling member 110 may be pivotably coupled to the horizontal extending member 108 at approximately its center 112. The pivoting motion of the vertical coupling member 110 may be obstructed by a stop 120 or the like. The stop 120 prevents the forward travel of the lower end of the vertical coupling member 110. As seen in FIG. 1, the vertical coupling member 110 on the viewer's left is prevented from traveling in a counter-clockwise direction. Correspondingly, for the viewer to view the other vertical coupling member 110 from the other side of the exercise device 100, the vertical coupling member 110 would be obstructed by the stop 120 from traveling in a clockwise direction. A counterweight 114 may sit atop the vertical coupling member 110 and, at least to a certain degree, balance the free weight connecting members 126 and the moments, or torques, arising via the vertical coupling member 110 about the center pivot 112.

At the lower end 122 of the vertical coupling member 110 is a pivotable connection 124 made between the vertical coupling member 110 and the free weight connecting member 126. The pivotable connection 124 may operate in a generally vertical manner, much like a hinge. For additional flexibility and articulation, the pivotable connection 124 may be a ball joint, or Heim joint, which also allows for some rotation about the pivotable connection 124. Additionally, other alternative joints or pivotable connections may be used to good advantage in the present invention so long as they provide the proper operability necessary for the present invention 100. Use of ball, or Heim, joints may allow for a greater range of motion that replicates a free range of motion and promotes generally unrestricted movement to provide a natural range of motion.

The free weight connecting member 126 extends forwardly towards the weightlifter W from the pivotable connection 124 with the vertical coupling member 110. Generally, the free weight connecting member 126 extends forwardly for the horizontal supporting member 102 to provide easy engagement of the weights 130 by the weightlifter W.

The free weight connecting member 126 enjoys a vertically pivoting connection 124 with the vertical coupling member 110. At the opposite end 132 of the free weight connecting member 126 is a horizontal pivotable connection 134 between the free weight connecting member 126 and a free weight clamp 136 or the like.

The free weight clamp 136 serves to hold weights 130 in place with respect to the corresponding free weight connecting member 126. The horizontal pivotable nature of the horizontal pivotable connection 134 allows the clamp 136 to be pivoted with respect to the free weight connecting member 126 and allow the weightlifter W to increase the distance between the dumbbells (weights) 130 and helps in placing and replacing weights on the dumbbell 130.

As can be seen by inspecting the Figures, the downward motion of the free weight connecting member 126 is obstructed and prevented by the horizontal supporting member 102. This means that the weightlifter W can rest the weights 130 on the horizontal supporting member 102 by causing the free weight connecting member 126 to rest on the horizontal supporting member 102.

Care must be taken to ensure that the vertical coupling member 110 does not flex too far forward and allow the free weight connecting member 126 to pivot past the horizontal supporting member 102. It is for this reason that stop 120 is set into place forward of the vertical coupling member 110 so that the weights 130 or the weightlifter W do not allow the vertical coupling member 110 to flex too far forward at its lower end 122. In an alternative embodiment of the invention, rear stops (not shown) similar to the front stops 120 may be made to prevent the rearward pivoting of the vertical coupling members 110 to ensure that the weights 130 do not fall or tilt too far backwards. The moment arm between the center 112 of the vertical coupling member 110 and the lower end 122 of the vertical coupling member 110 may be sufficiently short so that this acts effectively as a stop and prevents the excessive rearward travel of the weights 130.

As seen in FIG. 1, cables 140 are attached to the vertical attachment member 106 and are strung over a pulley 142 to engage a counterweight 144. The counterweight 144 serves to compensate for the weight of the exercise device 100 of the present invention, and allows for easier adjustment along the vertical support 146 that is present as a part of the exercise stand 148 that aids in supporting the exercise device 100.

Figure 1:
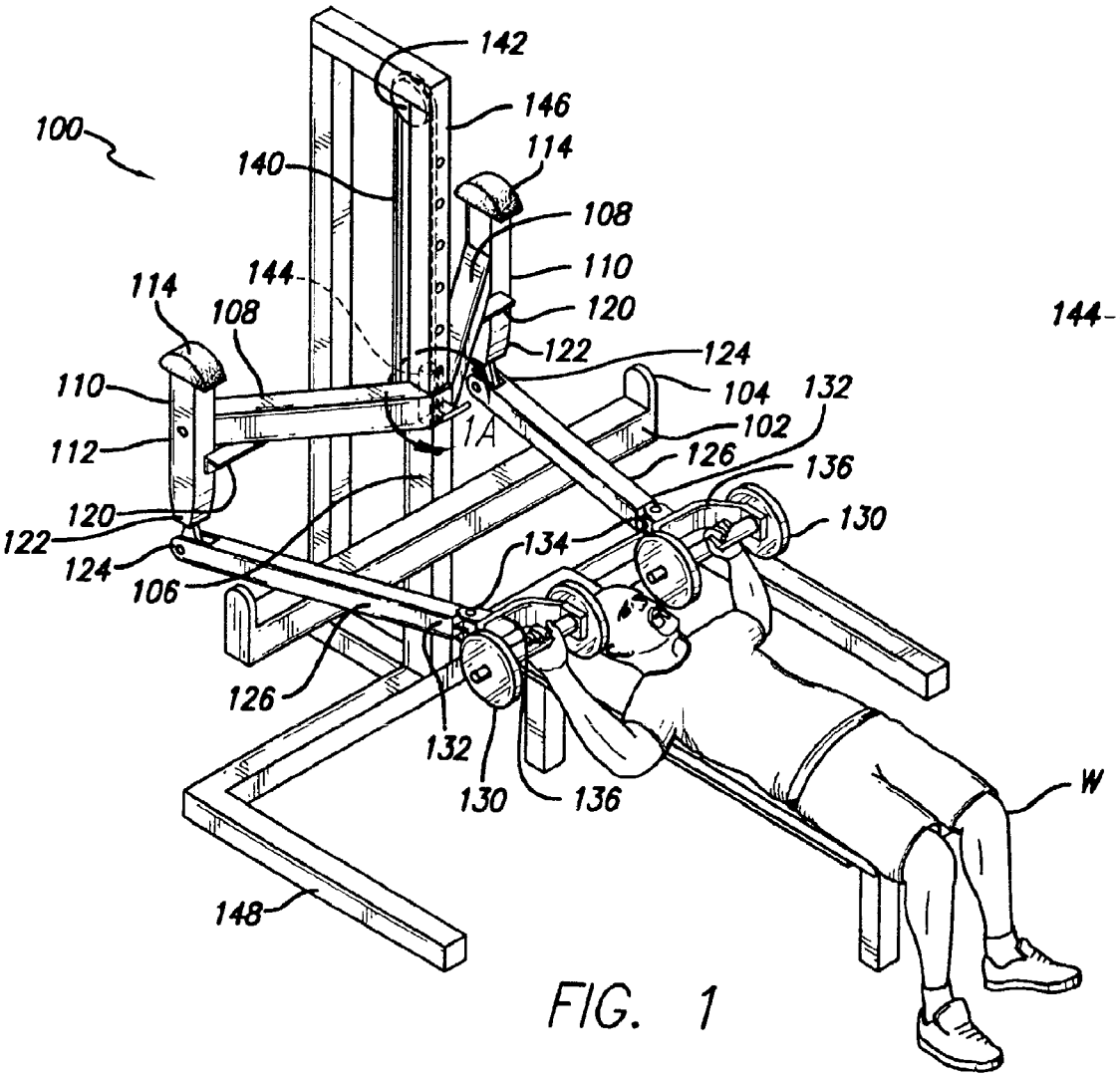
FIG. 1 is a right upper perspective view of a weightlifting system incorporating the present invention showing the weightlifter lifting dumbbells.

FIG. 1A shows a close-up of the encircled 1A portion shown in FIG. 1. There, the vertical support 146 has apertures 150 through which a pin 152 fits. In order to avoid the pin 152, the counterweight 144 has a groove 154, which accommodates the working end 156 when the position of the counterweight 144 corresponds to the position of pin 152.

Figure 2:
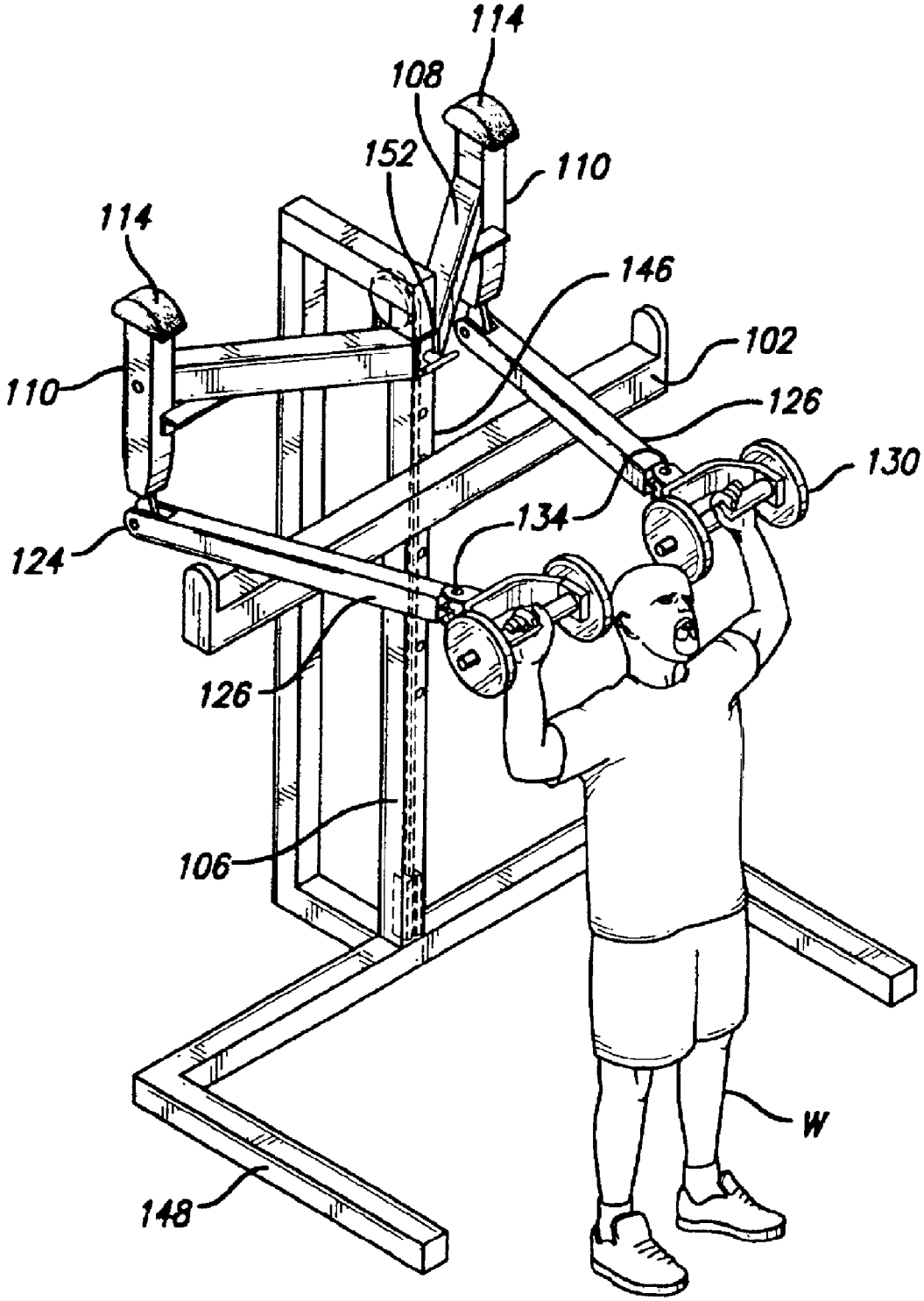
FIG. 2 is a right upper perspective view of the exercise device of the present invention shown in FIG. 1 showing the weightlifter in a standing position.

The pin 152 fits through a corresponding hole present in the vertical attachment member 106 so that the vertical attachment member 106 is securely coupled to and held by the vertical support 146. As shown in FIG. 2, this allows for the vertical adjustment of the exercise device 100 of the present invention so that the height of the exercise device 100 particularly the horizontal supporting member 102 may be adjusted so that the weights 130 are spotted appropriately for the weightlifter W.

Figure 3:
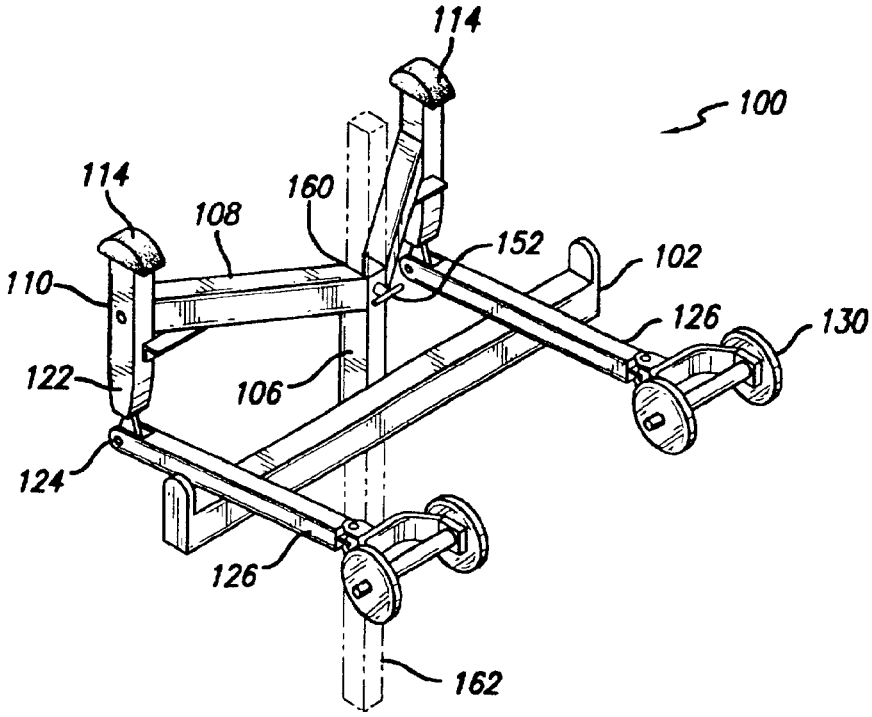
FIG. 3 is a right upper perspective view of a present invention with the vertical attachment member having an open back end and a vertical support beam shown in phantom.

FIG. 3 shows an alternative embodiment of the present invention where the rearward area 160 of the vertical attachment member 106 is open, such that the vertical attachment member 106 is open-ended. This then allows the attachment of the exercise device 100 via the vertical attachment 106 and vertical securement by a pin 152 or the like to a vertical support 162. Additionally, in an alternative embodiment, a latch or other mechanism may be used to ensure horizontal securement of the vertical attachment member 106 and the exercise device 100 to the vertical support 162 (shown in phantom).

Figure 4:
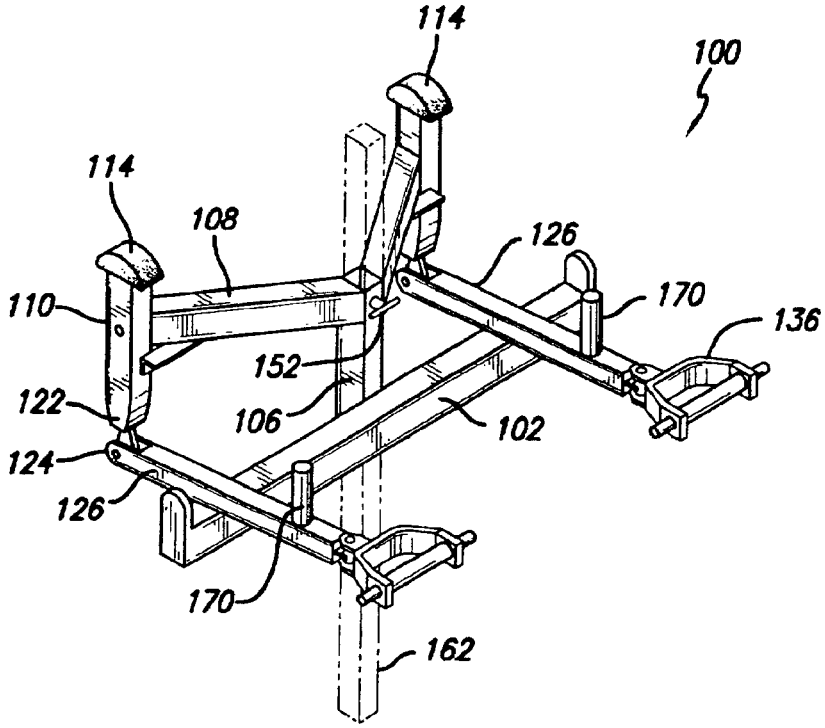
FIG. 4 shows an alternative embodiment of the exercise device shown in FIG. 3 with the vertical support shown in phantom, and weight posts shown on the free weight connecting members near the weights' supports.

FIG. 4 shows additional weight posts 170 that allow the application of additional weights upon the free weight connecting member 126.

Figure 5:
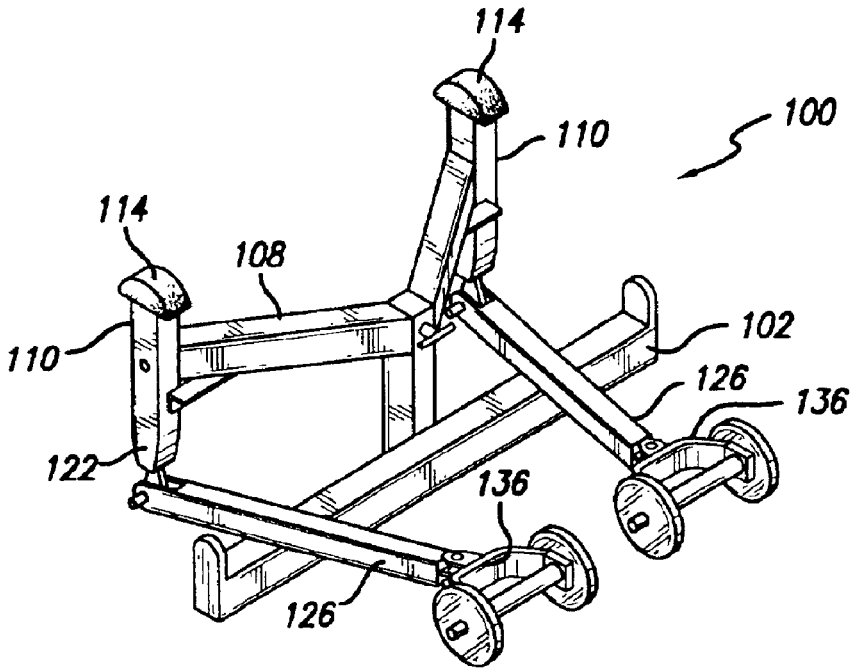
FIG. 5 shows an upper right perspective view of the exercise device of the present invention with the free weight connecting member shown resting on the horizontal supporting member.
Figure 6:
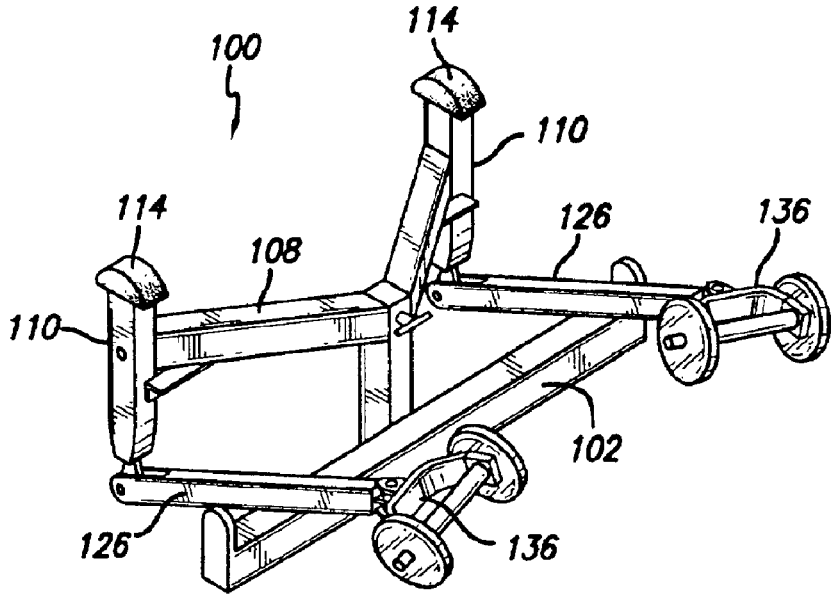
FIG. 6 shows an upper right perspective view of an upper right perspective view of the exercise device of FIG. 5 with the free weight connecting members pivoted above the horizontal supporting member.

FIGS. 5 and 6 show the pivoting articulation of the free weight connecting members 126 with respect to the vertical coupling member 110, as well as the free weight clamps 136 with respect to the free weight connecting members 126.

Figure 7:
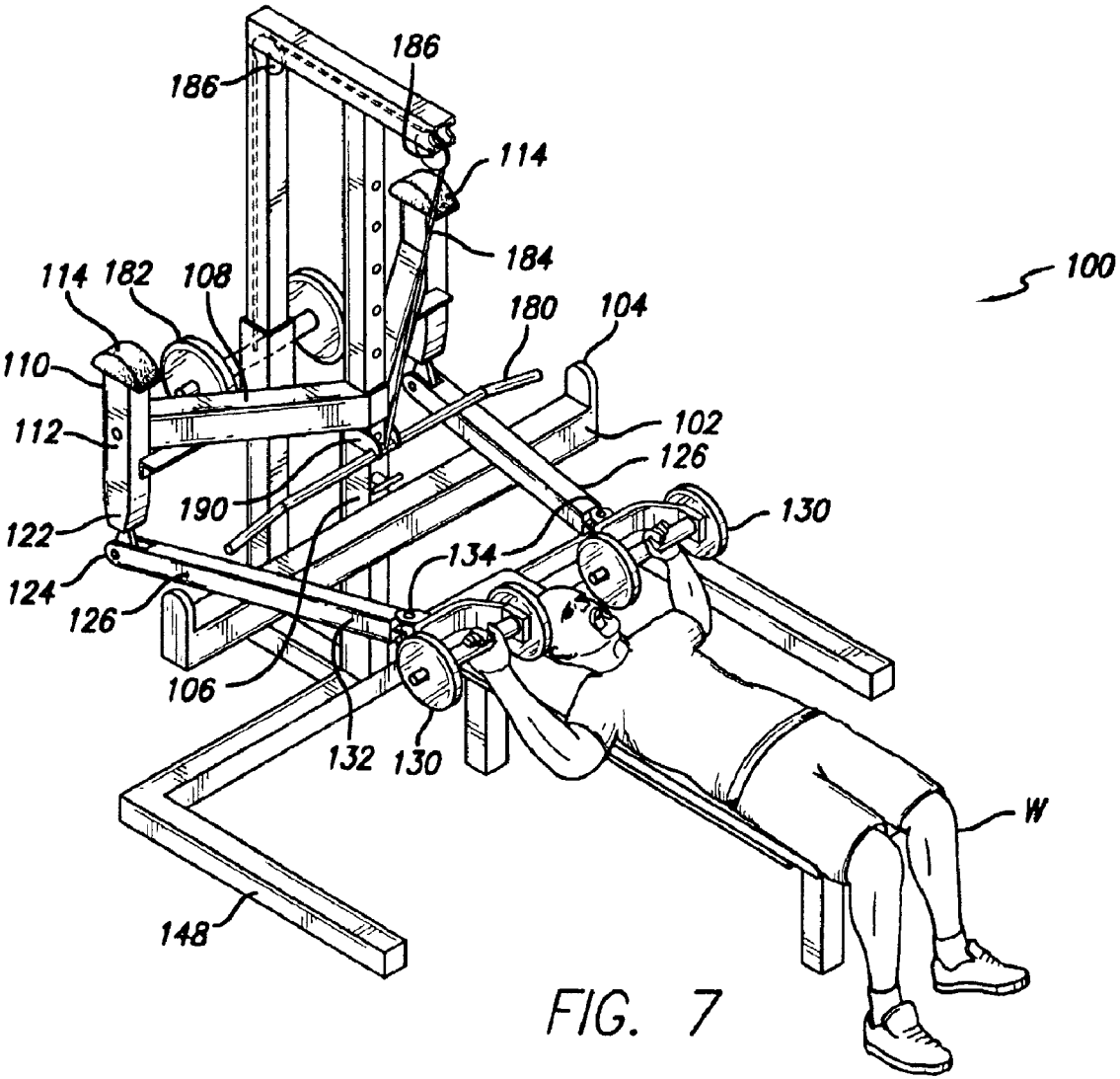
FIG. 7 shows an upper right perspective view of the exercise device of the present invention used in conjunction with an existing weightlifting system with a counterweight provided by a bar for exercising the latissimus dorsi muscles, known as a "lat bar."

In an alternative embodiment, FIG. 7 shows the exercise device 100 of the present invention where a bar 180 coupled to weights 182 serves to provide a counterweight mechanism for the exercise device 100. The bar 180 is generally known in the art as a "lat bar" as it is used to exercise the latissimus dorsi muscles for weightlifters W. The lat bar 180 is connected by a cable 184 and over pulleys 186 to a weight 182. The counterweights 182 are adjustable as adjustable weights for the lat bar 180 and a hooking mechanism 190 serves to constructively engage the lat bar 180 such that the vertical adjustment of the vertical attachment member 106 is made easier.

Figure 8:
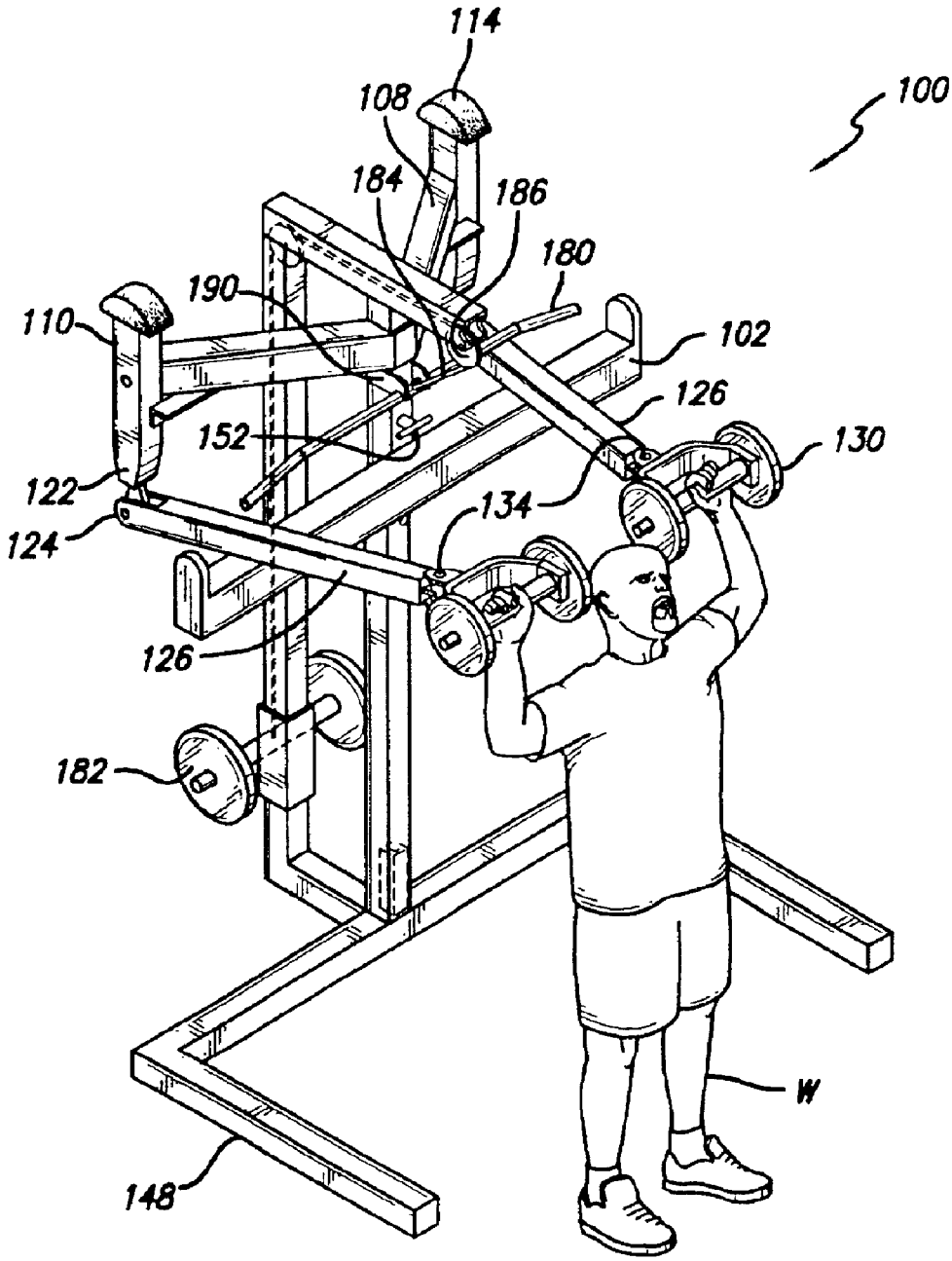
FIG. 8 shows an upper right perspective view of the exercise system of FIG. 7 with the weightlifter shown in a standing position.

As shown in FIG. 8, the counterweight 182 provides for easier vertical adjustment of the exercise device 100.

Figure 9:
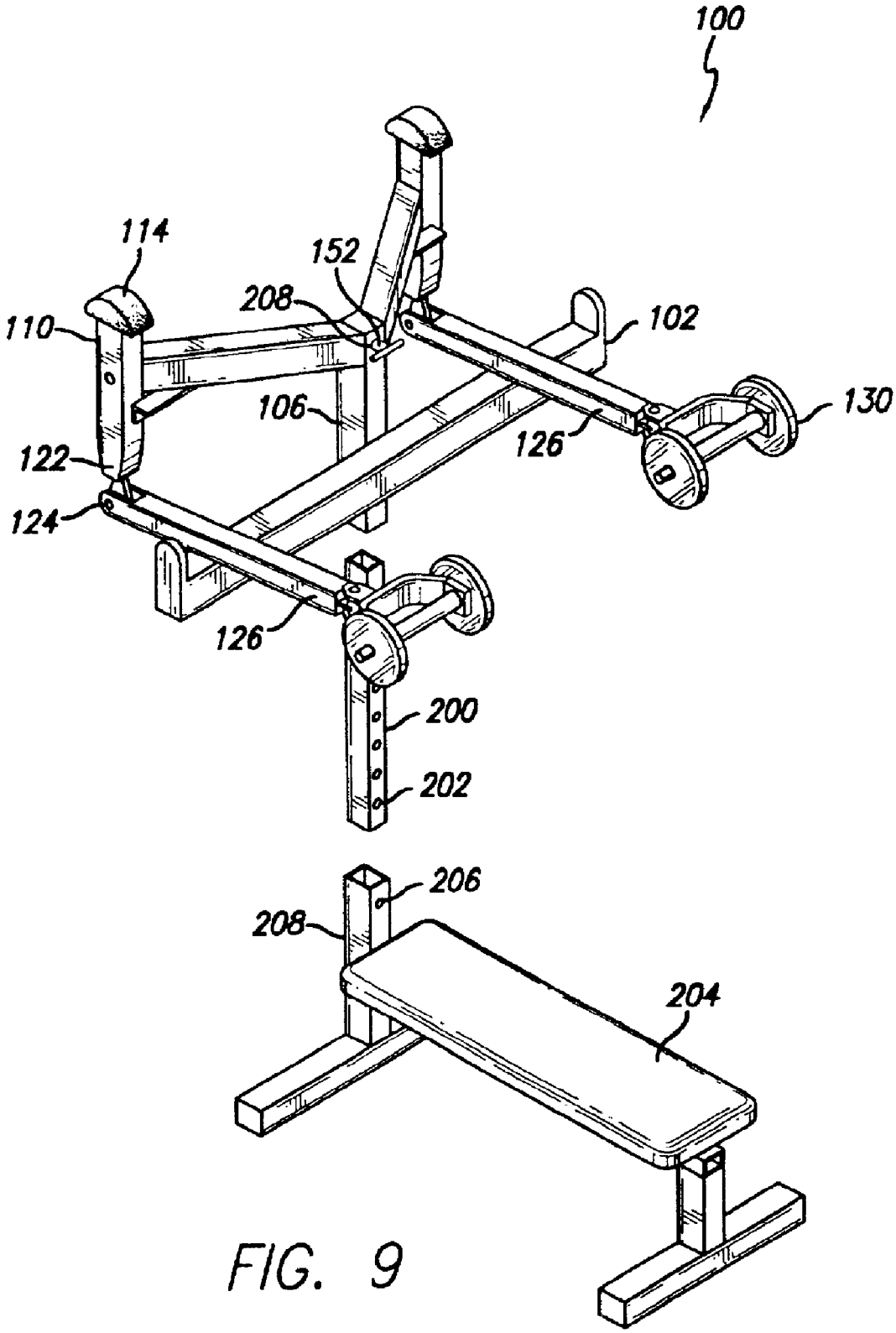
FIG. 9 shows an upper perspective view of a weightlifting bench retrofitted to incorporate the present invention.

In FIG. 9, an alternative embodiment of the present invention is shown. The exercise device 100 is attached as by a vertical post 200, having a series of apertures 202 to a weight bench 204. The vertical post 200 is attachable as by a pin 152 to a similar aperture 206 in a receptacle 208 present at the head of the weight bench 204. The vertical attachment member 106 for the exercise device 100 may then be attachable as by a pin 152 to the vertical post 200.

Figure 10:
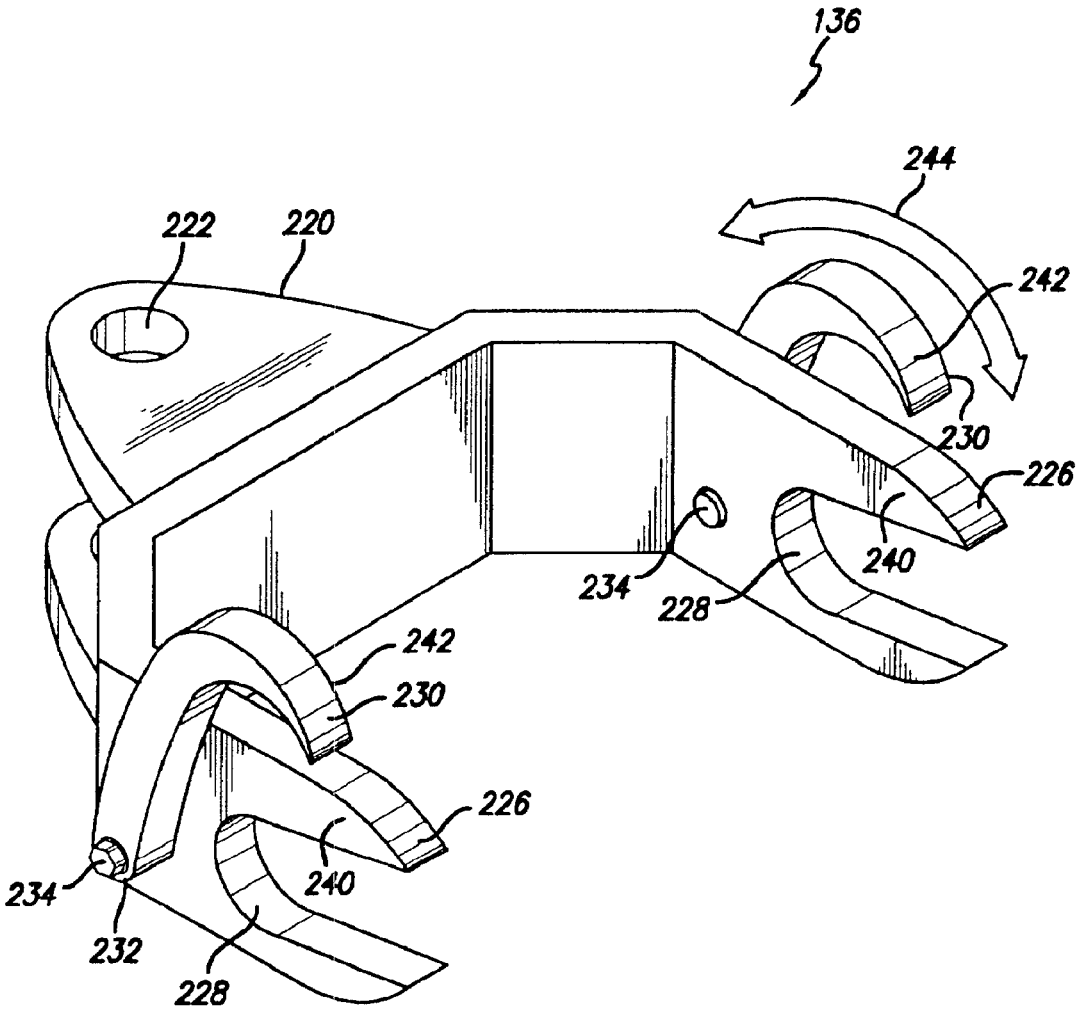
FIG. 10 is an upper right perspective view of a free weight clamp according to the present invention.

FIG. 10 shows one embodiment of the free weight clamp 136 that may constructively be used in conjunction with the present invention. A rear coupling 220 provides for horizontal pivoting with respect to the free weight connecting member 126 when a pin or other device is threaded through the holes or apertures 222 present in the rear coupling 220. The pin (not shown) traveling through the holes 222 connects the clamp 136 to the free weight connecting member 126 and then serves as an axle about which the free weight clamp 136 may pivot.

The free weight clamp 136 generally has two forks 226 which are disposed in a generally upward direction so as to urge the barbell or dumbbell by gravity to the lower end 228 of the fork 226. A latch 230 is pivotably connected to the free weight clamp 136 adjacent the forks 226 in its rearmost end 232 by a pin, bolt or screw 234. Once the weight, barbell, or dumbbell has been inserted in the forks 226, a latch 230 then pivotably descends to prevent the bar (not shown) engaged by the forks 226 from exiting out the mouths of the forks 226. This holds the weight in place so that it is not inadvertently disengaged by the weightlifter W, as the range of travel for the latch 230 will not go beyond the top 240 of the fork 226. The downwardly extending latching portion 242 is able to maintain the bar in place despite movement of the bar inside the fork 226. Arrow 244 generally indicates the direction of motion of the latch 230.

In an alternative embodiment, free weight clamps 136 may be interconnected to act as a single operative member. This would then cause the weights 130 to act much in a similar manner as to a barbell, as both individual dumbbell elements would be connected. One means by which such an interconnection can be achieved is by attaching a pipe-like member between the two clamps 136. By connecting the clamps 136, the hands of the weightlifter W can then be positioned along the interconnecting member or along one or more of the grip areas naturally formed between the weights of one of the single dumbbells.

Figure 11:
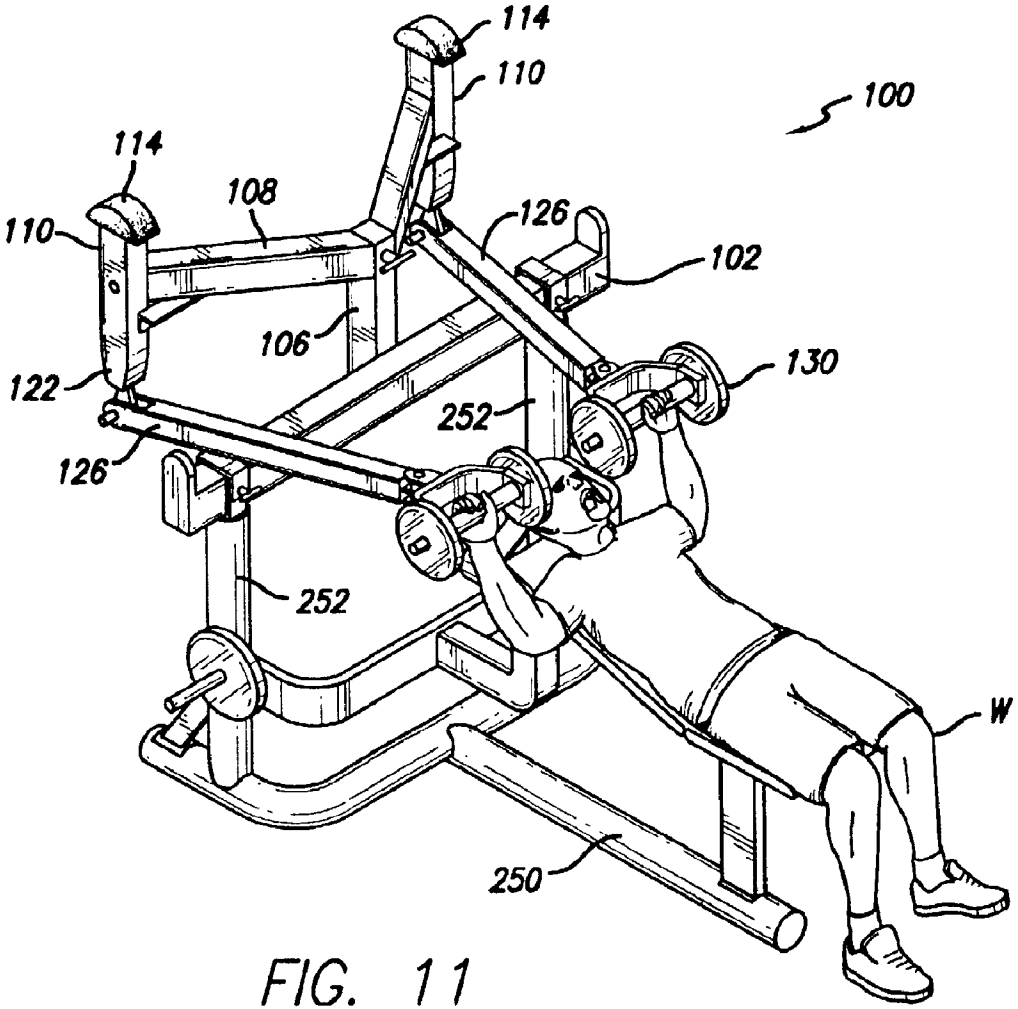
FIG. 11 shows an upper right perspective view of a weightlifting bench incorporating the present invention where the horizontal supporting member is coupled to a pair of spaced-apart upstanding posts.

FIG. 11 shows an alternative embodiment of the present invention, with the exercise device 100 being retrofittably adapted to a weightlifting bench system 250 having a set of parallel posts 252 coupled to the horizontal supporting member 102 in order to provide spotting for the weightlifter W. The vertical post 252 may be hollow and vertically descending posts (not shown) attached to the horizontal supporting member 102 may descend into the vertical post 252. Pins or the like as described above could then be used to adjustably position the horizontal supporting member 102 with respect to the weight bench system 250 with its vertical posts 252. Additionally, a clamping mechanism or the like such as those which are known in the art (not shown) can serve to adjustably clamp the horizontal support member 102 to the vertical posts 252. Other means known in the art may also be used to provide adjustable attachment of either the horizontal supporting member 102 or the vertical attachment member 106 to the weight bench system 250 shown in FIG. 11.

Figure 12:
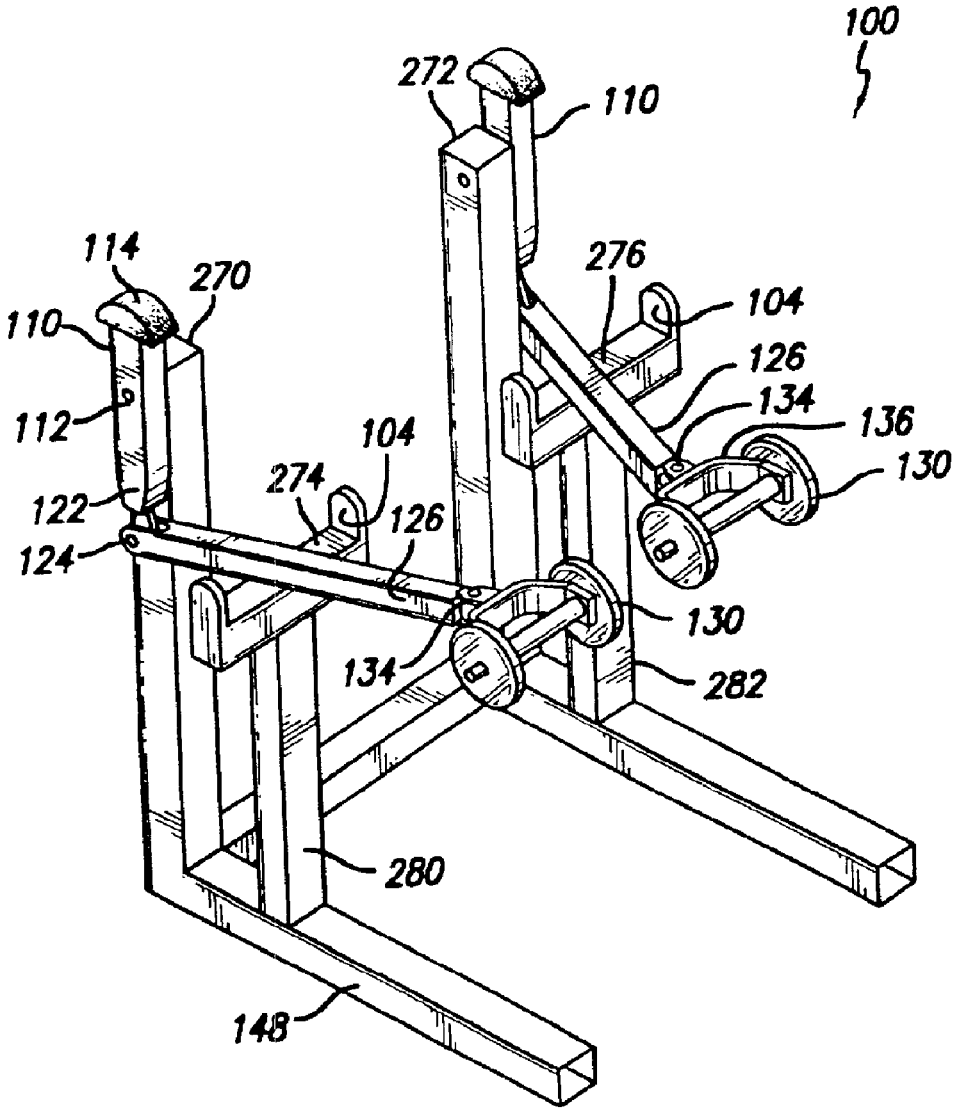
FIG. 12 shows an upper right perspective view of a weightlifting bench incorporating the present invention where the vertical supporting members are independently arranged and aligned with similarly independent horizontal supporting members.

As shown in FIG. 12, an alternative embodiment of the present invention allows for the elimination of the two rearwardly extending horizontal members 108 by separate vertical attachment posts 270, 272 to which the vertical coupling members 110 attach. The free weight connecting members 126 may then be individually supported by separate horizontal supporting members 274, 276. As in the other embodiments, outstanding flanges 104 serve to retain the free weight connecting members 126.

The individual horizontal supporting members 274, 276 may be adjustably supported by vertical posts 280, 282. Correspondingly, the right and left vertical posts 270, 272 may also be adjustable so that the weightlifter (not shown in FIG. 12) can adjustably dispose the weights 130 at a preferred height. The remaining elements in the alternative embodiment shown in FIG. 12 generally correspond to those in the other embodiments as shown in the drawings.

While the present invention has been described with regards to particular embodiments, it is recognized that additional variations of the present invention may be devised without departing from the inventive concept. Among such variations are numerous configurations where the connecting arms 126 are supported by underlying supports while enjoying a pivoting or pivotable connection at the rear of such arms 126. Additionally, such variations may include designs dedicated to specific exercises such as shoulder presses, chest presses, and the like.

What is claimed is:

1. An exercise device comprising:

a free weight connecting member adapted to be supported from a supporting member having a horizontal stop, said free weight connecting member being pivotably connectable to a free weight, said free weight connecting member being adaptable to rest upon said horizontal stop of said supporting member when said free weight connecting member is otherwise not supported;

a free weight connecting system including said free weight connecting member, said free weight connecting system further comprises;

an extending member extending outwardly and rearwardly from said vertical attachment member, said free weight connecting system further comprises;

a vertical coupling member pivotably coupled to said extending member and pivotably coupled to said free weight connecting member, said vertical coupling member pivotable in a generally horizontal direction whereby;

free weights may be attached to said free weight connecting member and supported by said supporting member until used by a weightlifter.

2. An exercise device as set forth in claim 1, wherein said free weight connecting system further comprises:

a stop attached to said extending member and preventing forward movement of said free weight connecting member by limiting pivoting movement of said vertical coupling member.

3. An exercise device, comprising:

a free weight connecting member adapted to be supported from a supporting member having a horizontal stop, said free weight connecting member being pivotably connectable to a free weight, said free weight connecting member being adaptable to rest upon said horizontal stop of said supporting member when said free weight connecting member is otherwise not supported;

a vertical attachment member being adaptable to be slidably and selectably attachable to a vertical support, said vertical attachment member coupled to said supporting members;

a vertical post, said vertical post coupled to said horizontal supporting member and serving to support said supporting member, said vertical post adapted to fit to a weight stand; whereby the exercise device may be supported by said weight stand and said weight stand may be retrofit by the exercise device;

said vertical attachment member is attachable to said vertical support by means selected from the group consisting of;

said vertical attachment member defining a hole through which a pin may pass to secure said vertical attachment member to said vertical support;

an adjustable set screw selectably fixing said vertical attachment member to said vertical support; and a clamp selectably fixing said vertical attachment member to said vertical support;

said free weight connecting member having a free end connectable to said free weight and a fixed end pivotably coupled to said vertical attachment member; whereby a free weight connected to said free end is free to move vertically about said pivotable fixed end;

a counterweight coupled to and counterbalancing said vertical attachment member;

said counterweight traveling through said vertical support; and said counterweight defining a slot, said pin traveling through said slot when said counterweight travels past said pin whereby free weights may be attached to said free weight connecting member and supported by said supporting member until used by a weightlifter.

4. An exercise device as set forth in claim 3, further comprising:

said counterweight comprising a weight coupled to said vertical support, said counterweight selectably coupled to said vertical attachment member by a crossbar, said crossbar usable by a weightlifter for exercise.

5. An exercise device, comprising:

a free weight connecting member adapted to be supported from a supporting member having a horizontal stop, said free weight connecting member being pivotably connected through a first pivot for forward and backward movement relative to said supporting member and being pivotably connectable through a second pivot to a free weight, said free weight connecting member being adaptable to rest upon said horizontal stop of said supporting member when said free weight connecting member is otherwise not supported;

a free weight connecting system including a vertical attachment member attached to said free weight connecting member, said free weight connecting system further comprises:

a vertical coupling member pivotably coupled to said extending member and pivotably coupled to said free weight connecting member, said vertical coupling member pivotable in a generally horizontal direction; whereby free weights may be attached to said free weight connecting member and supported by said supporting member until used by a weightlifter.

6. An exercise device, comprising:

a free weight connecting member adapted to be supported from a supporting member having a horizontal stop, said free weight connecting member being pivotably connected through a first pivot for forward and backward movement relative to said supporting member and being pivotably connectable through a second pivot to a free weight, said free weight connecting member being adaptable to rest upon said horizontal stop of said supporting member when said free weight connecting member is otherwise not supported;

a vertical attachment member being adaptable to be slidably and selectably attachable to a vertical support, said vertical attachment member coupled to said supporting members and, wherein said vertical attachment member is attachable to said vertical support by means selected from the group consisting of:

said vertical attachment member defining a hole through which a pin may pass to secure said vertical attachment member to said vertical support;

an adjustable set screw selectably fixing said vertical attachment member to said vertical support;

a clamp selectably fixing said vertical attachment member to said vertical support;

a counterweight coupled to and counterbalancing said vertical attachment member, said counterweight traveling through said vertical support; and said counterweight defining a slot, said pin traveling through said slot when said counterweight travels past said pin.

7. An exercise device, comprising:

a vertical attachment member;

an extending member extending outwardly and rearwardly from said vertical attachment member;

a vertical coupling member pivotably coupled to said extending member a free weight connecting system including a free weight connecting member coupled to said extending member by said vertical coupling member and pivotably coupled to said free weight connecting member;

a free weight clamp pivotably coupled to said free weight connecting member, said free weight clamp having:

first and second forks respectively defining first and second parallel slots, said first fork spaced apart from and parallel to said second fork;

a pivotable coupling coupled to said first and second forks, said pivotable coupling attached to said free weight connecting member and providing a pivotable connection between said first and second forks and said free weight connecting member; and first and second free weight retaining members pivotably and respectively coupled to said free weight clamp generally adjacent said first and second forks, said first and second free weight retaining members capable of retaining a free weight held by said first and second forks by preventing extraction of said free weight from said first and second forks until said first and second free weight retaining members are pivoted away from said first and second forks; so that said free weight may be removably attached to said free weight clamp, said free weight clamp holding said free weight until selectably released from said free weight clamp to prevent said free weight clamp from dropping said free weight;

a stop attached to said extending member and preventing forward movement of said vertical coupling member by limiting pivoting movement of said vertical coupling member; and a horizontal supporting member attached to said vertical attachment member, said horizontal supporting member supporting said free weight connecting member at a height sufficient to allow a lift distance for a weightlifter of said free weight, said height sufficient to allow a descent distance for a hand of said weightlifter upon disengaging said free weight, said horizontal supporting member performing as a mechanical spotter enabling said weightlifter to disengage said free weight without letting said free weight drop, said height being approximately equal to a height of shoulders of said weightlifter, said free weight connecting member resting upon said horizontal supporting member when said free weight connecting member is otherwise not supported; whereby said free weight may be attached to said free weight clamp and supported by said horizontal supporting member until used by said weightlifter, said horizontal supporting member allowing said weightlifter to freely lift said free weight upwardly and away from said horizontal supporting member and to readily and easily disengage said free weight by resting said free weight connecting member upon said horizontal supporting member.

8. An exercise device as set forth in claim 7, further comprising:

said vertical attachment member being adaptable to be slidably and selectably attachable to a vertical support, said vertical attachment member defining a hole through which a pin may pass to secure said vertical attachment member to said vertical support.

9. An exercise device as set forth in claim 7, further comprising:

a vertical post, said vertical post coupled to said horizontal supporting member and serving to support said horizontal member, said vertical post adapted to fit to a weight stand; whereby the exercise device may be supported by said weight stand and said weight stand may be retrofit by the exercise device.

10. An exercise device comprising:

a free weight connecting member adapted to be supported from a supporting member having a horizontal stop, said free weight connecting member being pivotably connectable to a free weight, said free weight connecting member being adaptable to rest upon said horizontal stop of said supporting member when said free weight connecting member is otherwise not supported;

a free weight clamp pivotably coupled to said free weight connecting member, said free weight clamp further comprises:

first and second forks respectively defining first and second parallel slots, said first fork spaced apart from and parallel to said second fork;

a pivotable coupling coupled to said first and second forks, said pivotable coupling attachable to said free weight connecting member and providing a pivotable connection between said pivotable coupling and said free weight connecting member; and first and second free weight retaining members pivotably and respectively coupled to said free weight clamp generally adjacent said first and second forks, said first and second free weight retaining members capable of retaining a free weight held by said first and second forks by preventing extraction of said free weight from said first and second forks until said first and second free weight retaining members are pivoted away from said first and second forks; whereby said free weight may be removably attached to said free weight clamp from dropping said free weight, whereby free weights may be attached to said free weight connecting member and supported by said supporting member until used by a weightlifter.

11. An exercise device, comprising:

a free weight connecting member adapted to be supported from a supporting member having a horizontal stop, said free weight connecting member being pivotably connected through a first pivot for forward and backward movement relative to said supporting member and being pivotably connectable through a second pivot to a free weight, said free weight connecting member being adaptable to rest upon said horizontal stop of said supporting member when said free weight connecting member is otherwise not supported;

a free weight clamp pivotably coupled to said free weight connecting member, said free weight clamp further comprises:

first and second forks respectively defining first and second parallel slots, said first fork spaced apart from and parallel to said second fork;

a pivotable coupling coupled to said first and second forks, said pivotable coupling attachable to said free weight connecting member and providing a pivotable connection between said pivotable coupling and said free weight connecting member; and first and second free weight retaining members pivotably and respectively coupled to said free weight clamp generally adjacent said first and second forks, said first and second free weight retaining members capable of retaining a free weight held by said first and second forks by preventing extraction of said free weight from said first and second forks until said first and second free weight retaining members are pivoted away from said first and second forks; whereby said free weight may be removably attached to said free weight clamp, said free weight clamp holding said free weight until selectably released from said free weight clamp to prevent said free weight clamp from dropping said free weight; whereby free weights may be attached to said free weight connecting member and supported by said supporting member until used by a weightlifter.

* * * * *